US012392137B2

(12) United States Patent
Lenney

(10) Patent No.: US 12,392,137 B2
(45) **Date of Patent: *Aug. 19, 2025**

(54) SELF-SUPPORTING BI-DIRECTIONAL CORRUGATED MESH LEAF PRECLUSION DEVICE

(71) Applicant: Gutterglove, Inc., Franklin, TN (US)

(72) Inventor: Robert C. Lenney, Lincoln, CA (US)

(73) Assignee: GUTTERGLOVE, INC., Franklin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/597,191

(22) Filed: Mar. 6, 2024

(65) Prior Publication Data

US 2024/0344326 A1 Oct. 17, 2024

Related U.S. Application Data

(63) Continuation of application No. 17/455,897, filed on Nov. 19, 2021, now Pat. No. 11,970,861, which is a continuation of application No. 17/027,664, filed on Sep. 21, 2020, now Pat. No. 11,193,280, which is a continuation of application No. 16/356,955, filed on Mar. 18, 2019, now Pat. No. 10,781,592, which is a continuation of application No. 15/920,407, filed on Mar. 13, 2018, now Pat. No. 10,233,648, which is a continuation of application No. 15/096,178, filed on Apr. 11, 2016, now Pat. No. 9,915,070, which is a (Continued)

(51) Int. Cl.
*E04D 13/076* (2006.01)
*E04D 13/064* (2006.01)

(52) U.S. Cl.
CPC ..... *E04D 13/076* (2013.01); *E04D 13/064* (2013.01)

(58) Field of Classification Search
CPC ..... E04D 13/076; E04D 13/074
USPC ..... 52/12
See application file for complete search history.

(56) References Cited

U.S. PATENT DOCUMENTS

| | | | |
|---|---|---|---|
| 1,732,058 | A | 10/1929 | Martini |
| 2,229,381 | A | 1/1941 | Grow |
| 2,288,121 | A | 6/1942 | Sandmeyer |

(Continued)

FOREIGN PATENT DOCUMENTS

| | | |
|---|---|---|
| AU | 2013201320 | 3/2013 |
| CA | 1310167 | 11/1992 |

(Continued)

OTHER PUBLICATIONS

Valor Gutter Guard's Melt Away Use Guide, published Apr. 2014.

*Primary Examiner* — Beth A Stephan
(74) *Attorney, Agent, or Firm* — Jonathan Kidney; Glen Gross; Intelink Law Group, P.C.

(57) ABSTRACT

A roof gutter for the purpose of keeping small debris out of the gutter and allowing rainwater to pass into the gutter. The covering is comprised of a water permeable, weather resistant mesh having apertures of a pre-determined size for passing water, the mesh sized to substantially cover a rain gutter; corrugations formed in the mesh; a debris collection first trough disposed along a longitudinal axis of the mesh, formed by making at least two bends in the mesh, the first trough located between a longitudinal midline of the mesh and a front gutter end of the mesh.

33 Claims, 11 Drawing Sheets

Related U.S. Application Data continuation of application No. 14/620,729, filed on Feb. 12, 2015, now abandoned.

(60) Provisional application No. 61/939,005, filed on Feb. 12, 2014.

(56) References Cited

U.S. PATENT DOCUMENTS

| | | | |
|---|---|---|---|
| 2,569,568 | A | 10/1951 | Lipshaw |
| 2,583,422 | A | 1/1952 | Haddon |
| 2,674,961 | A | 4/1954 | Lake |
| 2,935,954 | A | 5/1960 | Matthews |
| 2,997,763 | A | 8/1961 | Serfass |
| 3,350,045 | A | 10/1967 | Mayers |
| 3,630,383 | A | 12/1971 | Reeves |
| 3,691,343 | A | 9/1972 | Norman |
| 3,925,264 | A | 12/1975 | Corte |
| 4,254,595 | A | 3/1981 | Crossien |
| 4,308,696 | A | 1/1982 | Schroeder |
| 4,435,466 | A | 3/1984 | Kuhnel et al. |
| 4,573,290 | A | 3/1986 | Fleming |
| 4,604,837 | A | 8/1986 | Beam |
| 4,646,488 | A | 3/1987 | Burns |
| 4,745,710 | A | 5/1988 | Davis |
| 4,750,300 | A | 6/1988 | Winger |
| 4,755,229 | A | 7/1988 | Armanini |
| 4,769,526 | A | 9/1988 | Taouil |
| 4,827,686 | A | 5/1989 | Stamper |
| 4,941,299 | A | 7/1990 | Sweers |
| 4,949,514 | A | 8/1990 | Weller |
| 4,954,015 | A | 9/1990 | McGowan |
| 4,959,932 | A | 10/1990 | Pfeifer |
| 5,010,696 | A | 4/1991 | Knittel |
| 5,035,092 | A | 7/1991 | Brant |
| 5,038,528 | A | 8/1991 | Brant |
| 5,044,581 | A | 9/1991 | Dressler |
| 5,067,675 | A | 11/1991 | Brant |
| 5,092,086 | A | 3/1992 | Rognsvoog, Sr. |
| 5,098,045 | A | 3/1992 | Pepper |
| 5,107,635 | A | 4/1992 | Carpenter |
| 5,109,640 | A | 5/1992 | Creson |
| 5,127,200 | A | 7/1992 | Doran |
| 5,181,350 | A | 1/1993 | Meckstroth |
| 5,216,852 | A | 6/1993 | Bemis et al. |
| 5,228,247 | A | 7/1993 | Dressler |
| 5,257,482 | A | 11/1993 | Sichel |
| 5,261,195 | A | 11/1993 | Buckenmaier |
| 5,315,090 | A | 5/1994 | Lowenthal |
| 5,371,979 | A | 12/1994 | Kwiatkowski et al. |
| 5,375,379 | A | 12/1994 | Meckstroth |
| 5,391,858 | A | 2/1995 | Tourangeau et al. |
| 5,398,464 | A | 3/1995 | Jacobs |
| 5,406,754 | A | 4/1995 | Cosby |
| 5,406,756 | A | 4/1995 | Bemis et al. |
| 5,438,803 | A | 8/1995 | Blizard, Jr. |
| 5,459,965 | A | 10/1995 | Meckstroth |
| D364,338 | S | 11/1995 | Cline |
| 5,522,185 | A | 6/1996 | Cline |
| D372,421 | S | 8/1996 | Cline |
| 5,558,705 | A | 9/1996 | Keemer et al. |
| 5,570,557 | A | 11/1996 | Kwiatkowski et al. |
| 5,617,678 | A | 4/1997 | Morandin |
| 5,640,809 | A | 6/1997 | Iannelli |
| 5,729,931 | A | 3/1998 | Wade |
| 5,759,255 | A | 6/1998 | Venturini et al. |
| 5,836,117 | A | 11/1998 | Johnson |
| 5,842,311 | A | 12/1998 | Morin |
| 5,842,469 | A | 12/1998 | Rapp et al. |
| 5,848,857 | A | 12/1998 | Killworth et al. |
| 5,878,533 | A | 3/1999 | Swanfeld |
| 5,893,240 | A | 4/1999 | Ealer, Sr. |
| D418,403 | S | 1/2000 | Cline |
| D419,863 | S | 2/2000 | Mullane |
| 6,035,587 | A | 3/2000 | Dressler |
| 6,134,843 | A | 10/2000 | Tregear |
| 6,194,049 | B1 | 2/2001 | Bindschedler-Galli et al. |
| 6,194,519 | B1 | 2/2001 | Blalock et al. |
| 6,205,715 | B1 | 3/2001 | Rex |
| 6,223,777 | B1 | 5/2001 | Smith et al. |
| 6,225,600 | B1 | 5/2001 | Burris |
| 6,266,929 | B1 | 7/2001 | Cline |
| 6,341,462 | B2 | 1/2002 | Kiik et al. |
| D457,423 | S | 5/2002 | Mullane |
| 6,412,228 | B1 | 7/2002 | Meckstroth |
| 6,468,613 | B1 | 10/2002 | Kitano |
| 6,543,729 | B1 | 4/2003 | Ylonen |
| D475,613 | S | 6/2003 | Mullane |
| 6,598,352 | B2 | 7/2003 | Higginbotham |
| 6,607,781 | B2 | 8/2003 | Joedicke et al. |
| D481,929 | S | 11/2003 | McNichol |
| 6,700,098 | B1 | 3/2004 | Wyatt et al. |
| 6,708,452 | B1 | 3/2004 | Tenute |
| 6,759,630 | B1 | 7/2004 | Tenute |
| D494,461 | S | 8/2004 | Dressler |
| D495,595 | S | 9/2004 | Dressler |
| D499,331 | S | 12/2004 | Dressler |
| 6,933,007 | B2 | 8/2005 | Fensel et al. |
| 6,942,419 | B2 | 9/2005 | Knak et al. |
| 6,944,991 | B2 | 9/2005 | Kim |
| 6,944,992 | B2 | 9/2005 | Brochu |
| 6,951,077 | B1 | 10/2005 | Higginbotham |
| 6,951,323 | B1 | 10/2005 | McNichol |
| D511,451 | S | 11/2005 | Mullane |
| 6,959,512 | B2 | 11/2005 | Cobb |
| D514,670 | S | 2/2006 | Handley |
| 7,017,614 | B2 | 3/2006 | Handley |
| D519,025 | S | 4/2006 | Dressler |
| 7,056,422 | B2 | 6/2006 | Swistun |
| 7,104,012 | B1 | 9/2006 | Bayram |
| 7,127,852 | B1 | 10/2006 | Dressler |
| 7,174,677 | B1 | 2/2007 | Dressler |
| 7,174,688 | B2 | 2/2007 | Higginbotham |
| 7,191,564 | B2 | 3/2007 | Higginbotham |
| 7,241,500 | B2 | 7/2007 | Shiao et al. |
| 7,310,912 | B2 | 12/2007 | Lenney |
| 7,340,863 | B1 | 3/2008 | Dressler |
| 7,434,358 | B2 | 10/2008 | Smith |
| 7,448,167 | B2 | 11/2008 | Bachman |
| 7,493,686 | B2 | 2/2009 | Barford |
| 7,516,576 | B1 | 4/2009 | Mullane |
| 7,597,119 | B2 | 10/2009 | Boettner |
| 7,624,541 | B2 | 12/2009 | Gentry |
| 7,677,271 | B2 | 3/2010 | Boettner |
| 7,726,076 | B2 | 6/2010 | Staub |
| 7,793,465 | B2 | 9/2010 | McCann |
| 7,913,458 | B2 | 3/2011 | Higginbotham |
| D638,920 | S | 5/2011 | Ealer, Sr. |
| 7,975,435 | B2 | 7/2011 | Lenney |
| 8,033,058 | B2 | 10/2011 | Block |
| 8,079,183 | B2 | 12/2011 | Lenney |
| 8,251,302 | B2 | 8/2012 | Sloan, Jr. |
| 8,276,321 | B2 | 10/2012 | Bell |
| 8,312,677 | B2 | 11/2012 | Higginbotham |
| 8,418,410 | B2 | 4/2013 | Martin |
| 8,438,788 | B2 | 5/2013 | Bell et al. |
| 8,479,454 | B2 | 7/2013 | Lenney |
| 8,495,837 | B2 | 7/2013 | McCoy |
| 8,572,899 | B1 | 11/2013 | Pearce et al. |
| 8,607,827 | B2 | 12/2013 | Bell |
| 8,677,694 | B2 | 3/2014 | Ash |
| 8,689,837 | B1 | 4/2014 | Smith |
| 8,720,132 | B2 | 5/2014 | Chihlas |
| D709,357 | S | 7/2014 | Bell |
| 8,782,960 | B2 | 7/2014 | Nark |
| 8,901,458 | B2 | 12/2014 | Aussi |
| 9,080,328 | B1 | 7/2015 | Smith |
| D752,722 | S | 3/2016 | Boettner |
| 9,309,995 | B2 | 4/2016 | Bell |
| 9,487,955 | B2 | 11/2016 | Breyer |
| D790,672 | S | 6/2017 | Benjamin |
| 9,890,535 | B2 | 2/2018 | Breyer |
| 9,915,070 | B2 | 3/2018 | Lenney |
| 9,976,309 | B2 | 5/2018 | Lenney |
| 9,982,438 | B2 | 5/2018 | Casey |

(56) References Cited

U.S. PATENT DOCUMENTS

| | | | |
|---|---|---|---|
| 10,081,937 | B2 | 9/2018 | Elliott |
| D837,048 | S | 1/2019 | Benjamin et al. |
| 10,233,647 | B2 | 3/2019 | Benjamin et al. |
| 10,233,648 | B2 | 3/2019 | Lenney |
| D878,189 | S | 3/2020 | Benjamin et al. |
| 10,781,592 | B2 | 9/2020 | Lenney |
| 11,193,280 | B2 | 12/2021 | Lenney |
| 11,970,861 | B2 * | 4/2024 | Lenney ..... E04D 13/076 |
| 2001/0054625 | A1 | 12/2001 | Iggulden |
| 2003/0046876 | A1 | 3/2003 | Higginbotham |
| 2003/0187539 | A1 | 10/2003 | Smith |
| 2003/0198736 | A1 | 10/2003 | Fensel et al. |
| 2005/0072114 | A1 | 4/2005 | Shiao et al. |
| 2005/0196124 | A1 | 9/2005 | Aldereguia et al. |
| 2005/0235577 | A1 | 10/2005 | Smith |
| 2005/0257432 | A1 | 11/2005 | Higginbotham |
| 2005/0279036 | A1 | 12/2005 | Brochu |
| 2006/0037252 | A1 | 2/2006 | Gosse et al. |
| 2006/0090404 | A1 | 5/2006 | Lovell |
| 2006/0117670 | A1 | 6/2006 | Tsioris |
| 2006/0179723 | A1 | 8/2006 | Robins |
| 2006/0196124 | A1 | 9/2006 | Bachman |
| 2006/0213129 | A1 | 9/2006 | Bachman |
| 2006/0230687 | A1 | 10/2006 | Ealer, Sr. |
| 2006/0277831 | A1 | 12/2006 | Bachman |
| 2006/0283096 | A1 | 12/2006 | Bachman |
| 2006/0288652 | A1 | 12/2006 | Gurr |
| 2007/0054129 | A1 | 3/2007 | Kalkanoglu et al. |
| 2007/0065640 | A1 | 3/2007 | Joedicke |
| 2007/0094939 | A1 | 5/2007 | Bachman |
| 2007/0107323 | A1 | 5/2007 | Higginbotham |
| 2007/0193012 | A1 | 8/2007 | Bergman et al. |
| 2007/0199276 | A1 | 8/2007 | Duque |
| 2007/0218251 | A1 | 9/2007 | Jacobs |
| 2007/0220814 | A1 | 9/2007 | Faulks |
| 2007/0234647 | A1 | 10/2007 | Higginbotham |
| 2007/0246449 | A1 | 10/2007 | Bachman |
| 2008/0000169 | A1 | 1/2008 | Handley |
| 2008/0187708 | A1 | 8/2008 | Decker |
| 2008/0248241 | A1 | 10/2008 | Kalkanoglu et al. |
| 2009/0056234 | A1 | 3/2009 | Brochu |
| 2009/0064628 | A1 | 3/2009 | Mellott et al. |
| 2009/0139180 | A1 | 6/2009 | Kehs et al. |
| 2009/0300995 | A1 | 12/2009 | Nikolopoulos |
| 2010/0042579 | A1 | 2/2010 | Larsen et al. |
| 2011/0047930 | A1 | 3/2011 | Nark |
| 2011/0049118 | A1 | 3/2011 | Nark |
| 2011/0056145 | A1 | 3/2011 | Lenney |
| 2011/0067318 | A1 | 3/2011 | Lenney et al. |
| 2011/0138698 | A1 | 6/2011 | Neumann |
| 2011/0253611 | A1 | 10/2011 | Higginbotham |
| 2012/0042579 | A1 | 2/2012 | McCoy |
| 2012/0049511 | A1 | 3/2012 | Bell et al. |
| 2012/0068452 | A1 | 3/2012 | Boettner |
| 2012/0144759 | A1 | 6/2012 | Higginbotham |
| 2013/0097943 | A1 | 4/2013 | Higginbotham |
| 2013/0160377 | A1 | 6/2013 | Sager |
| 2013/0160378 | A1 | 6/2013 | Higginbotham |
| 2013/0284650 | A1 | 10/2013 | Higginbotham |
| 2013/0319990 | A1 | 12/2013 | Casey |
| 2014/0013702 | A1 | 1/2014 | Pearce et al. |
| 2014/0069028 | A1 | 3/2014 | Lenney |
| 2014/0090311 | A1 | 4/2014 | Iannelli |
| 2014/0130929 | A1 | 5/2014 | Elliott et al. |
| 2014/0196400 | A1 | 7/2014 | Bell |
| 2014/0263001 | A1 | 9/2014 | Higginbotham |
| 2014/0291310 | A1 | 10/2014 | Iannelli |
| 2014/0326837 | A1 | 11/2014 | Rumsey |
| 2015/0143756 | A1 | 5/2015 | Higginbotham |
| 2015/0184394 | A1 | 7/2015 | Nark |
| 2016/0102459 | A1 | 4/2016 | Breyer |
| 2016/0168858 | A1 | 6/2016 | Breyer |
| 2017/0089071 | A1 | 3/2017 | Smith et al. |
| 2018/0179761 | A1 | 6/2018 | Higginbotham |
| 2018/0216755 | A1 | 8/2018 | Rumsey |

FOREIGN PATENT DOCUMENTS

| | | |
|---|---|---|
| CA | 2021168 | 2/2002 |
| CA | 2021169 | 2/2002 |
| CA | 2476351 | 11/2005 |
| CA | 2551297 | 12/2007 |
| CA | 2390777 | 5/2008 |
| CA | 2752598 | 3/2013 |
| CA | 2938647 | 1/2019 |
| EP | 1344640 | 4/2006 |
| EP | 2518226 | 10/2012 |
| FR | 2694775 | 11/1997 |
| JP | 06-146506 | 5/1994 |
| JP | 09228592 | 9/1997 |
| JP | 2000-008559 | 1/2000 |
| KR | 890010803 | 7/1989 |
| KR | 1998-016228 | 6/1998 |
| WO | WO9953157 | 10/1999 |

* cited by examiner

SELF-SUPPORTING BI-DIRECTIONAL CORRUGATED MESH LEAF PRECLUSION DEVICE

CROSS-REFERENCE TO RELATED APPLICATION(S)

This application is a continuation of U.S. patent application Ser. No. 17/455,897 filed Nov. 19, 2021, titled Self-Supporting Bi-Directional Corrugated Mesh Leaf Preclusion Device, which is a continuation of U.S. patent application Ser. No. 17/027,664 filed Sep. 21, 2020, now issued as U.S. Pat. No. 11,193,280 on Dec. 7, 2021, which is a continuation of U.S. patent application Ser. No. 16/356,955 filed on Mar. 18, 2019, now issued as U.S. Pat. No. 10,781,592 on Sep. 22, 2020, which is a continuation of U.S. patent application Ser. No. 15/920,407 filed Mar. 13, 2018, issued as U.S. patent Ser. No. 10/233,648 on Mar. 19, 2019, which is a continuation of U.S. patent application Ser. No. 15/096,178 filed Apr. 11, 2016, issued as U.S. Pat. No. 9,915,070 on Mar. 13, 2018, which is a continuation of U.S. patent application Ser. No. 14/620,729, filed on Feb. 12, 2015, which is a non-provisional application of U.S. Provisional Patent Application No. 61/939,005, filed Feb. 12, 2014, to which this application claims the benefit of all prior applications and are hereby incorporated by reference in their respective entireties.

FIELD

This invention relates to barriers for rain gutters and similar structures for keeping leaves and other debris out of the rain gutters. More particularly, this invention relates to rain gutter debris preclusion barriers, which utilize a conformed screen to allow water to pass into the gutter, but preclude debris from passing through the screen and into the gutter.

BACKGROUND

Prior art gutter debris preclusion devices are known to have difficulty in addressing excessive flow of rainwater coming off the roof of a house into the gutter. With excessive water flow, debris often accumulates on the device, clogging or impeding the effectiveness of the devise. Many complicated designs have been contemplated by others in the industry, each with their advantages and disadvantages. Of particular difficulty, is the need to support the "guard" over the gutter, wherein complicated and diverse support and bridging systems have been devised. These support systems add to the complexity, weight, and most importantly the cost of these guards. The industry was in need of a new system to support the guard over the gutter with easy installation, little or no increased weight, and without increasing the cost of the guard.

The present invention overcomes the deficiencies in the art by creating various systems and devices of screened gutter debris preclusion.

SUMMARY

The following presents a simplified summary in order to provide a basic understanding of some aspects of the claimed subject matter. This summary is not an extensive overview, and is not intended to identify key/critical elements or to delineate the scope of the claimed subject matter.

Its purpose is to present some concepts in a simplified form as a prelude to the more detailed description that is presented later.

Various embodiments describe a covering that goes over a roof gutter for the purpose of keeping leaves, pine needles and small debris out of the gutter and for allowing rainwater to pass through a permeable material and into the gutter.

For example, one aspect of the disclosed embodiments, a gutter debris preclusion device for securing to a top portion of a roof gutter that is attached to a building for keeping leaves and other debris out of the roof gutter is provided, comprising: a water permeable, weather resistant mesh having apertures of a pre-determined size for passing water, the mesh sized to substantially cover a rain gutter; corrugations in the mesh; and a debris collection trough disposed along a longitudinal axis of the mesh and positioned proximal to a gutter lip end of the mesh.

In another aspect of the disclosed embodiments, the device described above is provided, further comprising first and second wall portions of the trough connected together to form a tilted L-shaped reservoir, a bottom of the reservoir below the gutter lip end of the mesh, the first wall portion longer than the second wall portion, and the second wall portion angled upwards and towards the gutter lip end of the mesh; and/or wherein the mesh is formed from stainless steel wires, plastic, expanded metal, perforated metal, slotted metal or louvered metal; and/or wherein the first wall portion extends to a roof-side end of the mesh; and/or wherein the corrugations are configured to provide a planar stiffness to the mesh causing the mesh to be self-supporting over the gutter; and/or wherein the corrugations in the mesh are formed via at least one of stamping, pressing, and weaving; and/or further comprising: a front strip connector adapted to connect the gutter lip end of the mesh to a front of the gutter; and a rear strip connector adapted to connect the roof-side end of the mesh to either a rear of the gutter or a roof element neighboring the gutter; and/or wherein the trough is displaced up to 1.5" from the front strip connector; and/or wherein the trough is displaced up to 0.25" from the front strip connector; wherein the corrugations span from a roof-side end of the mesh to at least one of a first and second bend in the trough; and/or further comprising a second trough disposed in the mesh along a longitudinal axis of the of mesh; and/or wherein an angle formed by the connected first and second wall portions is less than 90 degrees; and/or wherein an angle formed by the connected first and second wall portions is greater than 90 degrees; and/or wherein at least one of the first and second wall portions is further angled to form a segmented or a curved reservoir bottom.

In yet another aspect of the disclosed embodiments, a gutter debris preclusion device for securing to a top portion of a roof gutter that is attached to a building for keeping leaves and other debris out of the roof gutter is provided, comprising: weather resistant means for passing water while restricting debris, sized to substantially cover a rain gutter; stiffness means in the weather resistant means; and a debris collection means disposed along a longitudinal axis of the weather resistant means and positioned proximal to a gutter lip end of the weather resistant means. In another aspect of the disclosed embodiments, the device described above is provided, further comprising a first wall portion and second wall portion of the debris collection means, wherein the first wall portion is longer than the second wall portion and the second wall portion is angled upwards and towards the gutter lip end of the weather resistant means, wherein a bottom of the debris collection means is below the gutter lip end of the weather resistant means; and/or further comprising: a front strip connector adapted to connect the gutter lip end of the weather resistant means to a front of the gutter; and a rear strip connector adapted to connect the roof-side end of the weather resistant means to either a rear of the gutter or a roof element neighboring the gutter; and/or wherein the debris collection means is displaced up to 1.5" from the front strip connector; and/or further comprising a second debris collection means disposed along a longitudinal axis of the weather resistant means; and/or wherein an angle formed by the connected first and second wall portions is less than 90 degrees; and/or wherein at least one of the first and second wall portions form a segmented or a curved debris collection means bottom.

DETAILED DESCRIPTION

Figure 1A:
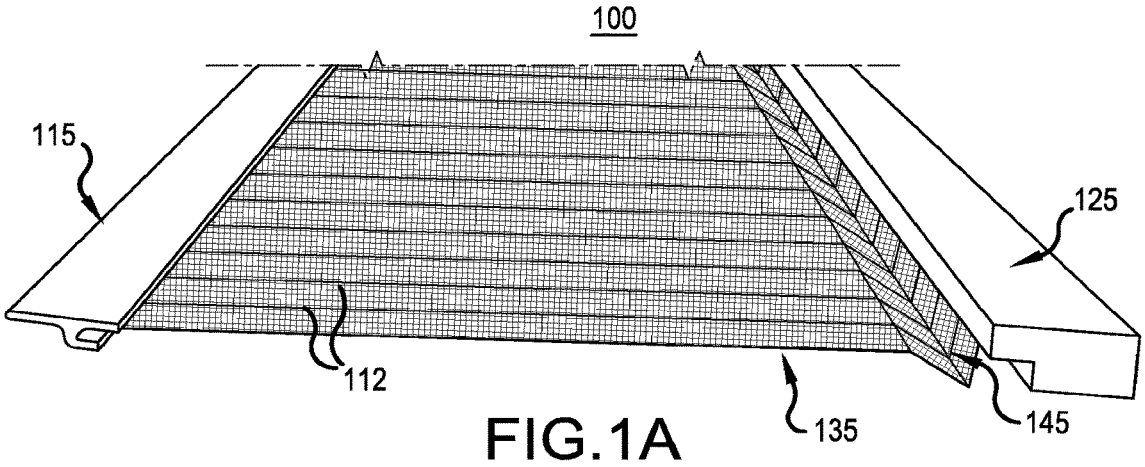
FIG. 1A is a side perspective view of an embodiment of a three-piece gutter cover.

FIG. 1A is a side perspective view 100 of an embodiment of a three piece gutter cover showing a rear strip connector 115 that goes to the roof (not shown), a front strip connector 125 that fastens to the front lip of a gutter (not shown) and a corrugated mesh 135 that spans between the rear strip connector 115 and the front strip connector 125, via trough 145. The mesh 135 in this embodiment is formed of a stainless steel material, but other weather resilient materials may be used. The mesh 135 is generally rectangular in shape having a longitudinal axis parallel to the gutter, so as to fit over the gutter. Most residential gutters being approximately 5 inches in width, and commercial gutters being up to 10 inches in width, the mesh 135 will be sized in most embodiments to be wide enough to cover the gutter, less the widths of the rear and front strip connectors 115, 125, if they are used.

Illustrated in FIG. 1A are corrugations 112 in the mesh 135, which can be of varying shapes, orientations, etc., but are of a configuration that provides sufficient rigidity in the mesh 135, so that it can free-formingly span the gutter without collapsing in the gutter. These corrugations 112 do not have to be perpendicular to rear strip connector 115. The corrugations do not have to be perpendicular to the front strip connector 125 in other exemplary embodiments.

Figure 1B:
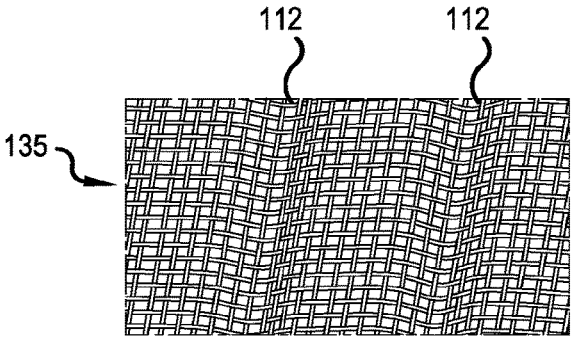
FIGS. 1B-C are illustrations of various meshes with corrugations that are formed with different diameter wires.
Figure 1C:
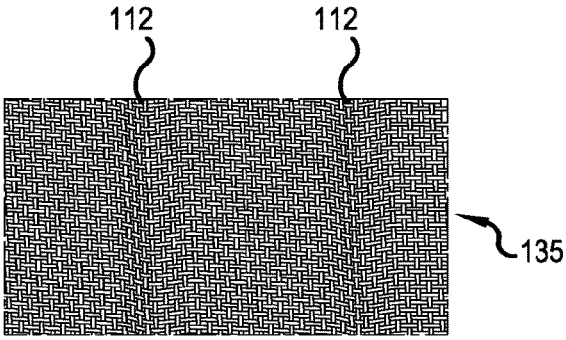

FIGS. 1B-C are illustrations of various meshes 135 with corrugations 112 that are formed with different diameter wires. For example, FIG. 1B shows a 30 wires per linear inch corrugation 112. FIG. 1C shows a 50 wires per linear inch corrugation 112. Of course, other wires per linear inch density (or metric equivalent) can be used, as well as perforations or other mechanisms for forming passageways in a material. FIGS. 1B-C are demonstrative of exemplary commercial embodiments and are understood not to be limiting.

In the various embodiments described herein, the mesh's corrugations 112 can be patterned to be rectangular, square, of various shapes, etc., and oriented substantial orthogonal (perpendicular) to the orientation of the lip of the gutter. The perpendicular orientation provides for linear or planar stiffness along the roof-to gutter lip line, resulting in a self-supporting mesh. The mesh's corrugations can be formed from stamping the mesh, pressing the mesh, or weaving the mesh in a corrugated form, and so forth.

The connectors 115 and 125 are similar to the lower and upper strips described in published application US 20110056145, published on Mar. 10, 2011, which is incorporated herein by reference in its entirety.

The corrugations 112 formed in the mesh 135 are formed similar to the corrugations formed in the mesh in published application US 20110056145, published on Mar. 10, 2011, which is incorporated herein by reference in its entirety.

The mesh 135 provides the function of allowing water to pass into the gutter while precluding debris from passing into the gutter. This corrugated mesh 135 is preferably formed as a woven screen of stainless steel wire or other wire-thread of suitable material. Important characteristics of the material forming the mesh include sufficiently high strength and inelasticity to function structurally, as well as resistance to corrosion in the gutter environment. Furthermore, it is advantageous that material forming the corrugated mesh 135 can be readily bent sufficient to cause the material to be readily corrugated into one of a variety of different cross-sections and hold that configuration after being so bent. Most preferably, the wire forming the corrugated mesh 135 extends in a pattern with some threads extending parallel with an upper edge (extending substantially parallel to the roof, when in use) of the overall corrugated mesh 135 and some of the wire/thread extending perpendicular to the upper edge. In such a configuration, the corrugation can occur to create the crests and valleys with only the threads, which run parallel with the upper edge needing to be bent. In such a configuration the corrugating of the fine mesh material forming the corrugated mesh 135 can more readily occur and this material formulating the corrugated mesh can more readily maintain this corrugated configuration during installation and use.

The corrugations 112 in the corrugated mesh 135 preferably have an amplitude between crests and valleys between one-fourth and one-tenth of the length of the corrugated mesh 135 between the upper edge and a lower edge (extending substantially parallel to the gutter lip when in use) of the mesh 135 and similar to a width of the opening in the gutter. Preferably, the corrugations 112 are in a repeating pattern. This pattern is most preferably a sinusoidal pattern with a curving crest and curving valley. Other configurations can also be provided for the corrugated mesh 135.

It should be apparent that the mesh may be of any material that is weather resistant, has apertures for drainage, and is of sufficient stiffness to bridge the gutter without the need for an auxiliary support. Therefore, the gutter cover can be constructed of other materials such as plastic, expanded metal, perforated metal, slotted metal or louvered metal slits, and so forth. Furthermore, the mesh, with its associated corrugations does not need to completely span the gutter. That is, the mesh's corrugations can be limited to certain portions, according to design preference, and may not need span the entirety of the gutter. For example, the trough may be corrugation free. It should also be apparent that the front strip connector and the rear strip connector can be formed from metal, plastic, or any other suitable material. As a matter of convention, the front strip connector may alternately be referred to as a gutter lip rail that is connected to the gutter lip side of the mesh, and the rear strip connector alternately referred to as a roof side rail that is connected to the roof side of the mesh.

It is understood that in various other embodiments, the trough 145 (shown in the various embodiments as adjacent to the front strip connector and parallel to the longitudinal axis), can be angled to the front strip connector as well as be oriented at an angle to the mesh's corrugations. Therefore, it is understood that mesh corrugation shapes can be modified as well as the trough's angles without departing from the spirit and scope of this disclosure. For example, the trough can have repeating angles, such as a zigzag, or turns, or smooth gradual turns and so forth, wherein the corrugations may conform to the frough angles.

In addition to assisting in stiffening the mesh, the corrugations may result in an non-smooth or uneven mesh surface, which naturally allows collected debris to dry quicker (due to separation between the debris and the mesh surface) and blow off more easily when there is ambient wind.

Figure 2:
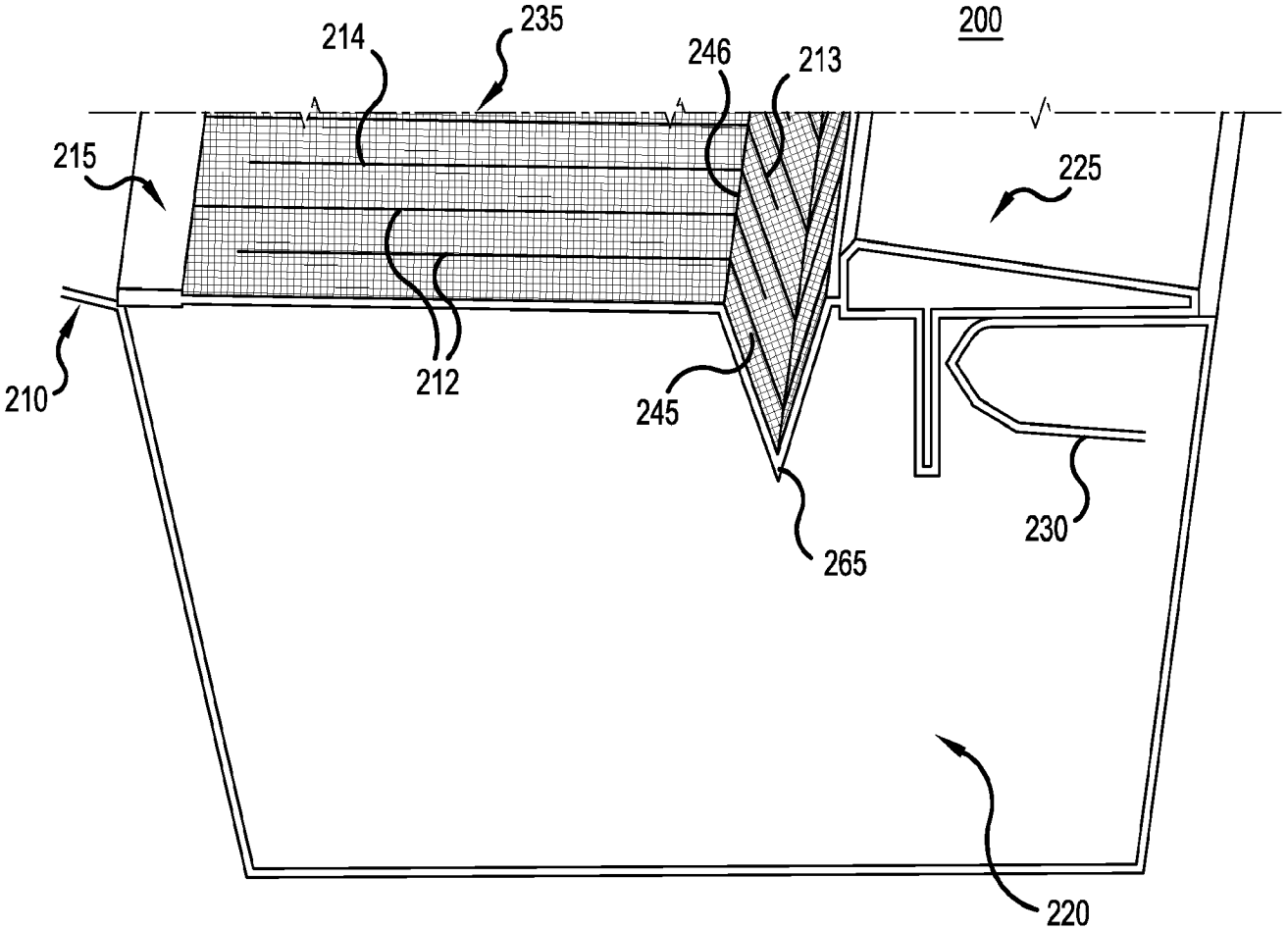
FIG. 2 is a semi-side cut-away illustration of the embodiment of FIG. 1A.

FIG. 2 is a semi-side cut-away illustration 200 of the embodiment of FIG. 1A. As illustrated, when the mesh 235 connects to the back of the roof 210 and the gutter 220, via strip connectors 215 and 225, a natural downward slope in mesh 235 is created toward the front lip 230 of gutter 220. The mesh 235 includes a plurality of corrugations 212. Accordingly, when rainwater comes down the roof 210 and on top of mesh 235, the rainwater naturally passes through the apertures in mesh 235 and a large portion thereof clings to the underside of mesh 235 without falling off. The lightweight and adhesive properties of rainwater allow it to cling to the underside of mesh 235, wherein the slope of the mesh 235 causes rainwater to travel towards frough 245. The bottom 265 of trough 245 is designed to be lower than the front lip 230 of gutter 220, thereby creating a barrier that deflects the underside rainwater down into the gutter 220. The arrangement of this "creased" structure prevents rainwater from running off the front of the gutter 220.

In various embodiments, it has been discovered that the cross sectional "crease" forming trough 245 also can operate to increase the structural integrity of the surface area of the mesh 235 over the gutter 220. It is understood for a large spanning mesh 235, the placement of trough 245 in the middle of mesh 235 may lessen its ability to independently support mesh 235. For example, if the mesh 235 is composed of a steel mesh having a wire diameter that is less than 0.01" thick, with a weave count of more than 32 wires per linear inch (See FIGS. 1B-C, for example), then placement of the trough 245 in the middle of mesh 235 will be insufficient to adequately stiffen the gutter spanning mesh 235 to be self-supporting over gutter 220.

If the wire diameter decreases, then the wire count per inch increases—this will make the mesh 235 less stiff and unable to sustain itself over a gutter 220 when a cross sectional crease (e.g., trough 245 or similar trough) is formed. For wire diameters that are between 0.009" and 0.01" (thicker wire applied to the lessor wire count per inch), with wire counts of 32 to 60 per inch, the trough 245 can be displaced from the front strip connector 215 by up to 1.5."

For wire diameters that are between 0.007" and 0.089," with wire counts of 36 to 56 per inch, the trough 245 can be placed up to 0.75"' from the front strip connector 225. For wire diameters that are between 0.005" and 0.069," with wire counts of 40 to 50 per inch, the trough 245 can be placed up to 0.25" from the front strip cormector 225.

However, the trough 245 could be formed on the mesh 235 between the rear and front strip connectors (215 and 225) on a standard 5 inch gutter top opening, if the wire diameter is between 0.011" and 0.015" and the wire count is between 20 and 31 per inch. If a lower wire count per inch of between 10 and 19 is needed, then the wire diameter would need to be between 0.016" and 0.02." However, with the wider mesh hole openings, as in the latter example, pine needles and small leafy debris may penetrate into the mesh 235 and into the gutter 220, potentially clogging the gutter 220 to cause rainwater to spill out of the gutter 220. Accordingly, while a lower wire count per inch for mesh 235, such as 20 wires per inch or less, can be used, it will be less effective in debris preclusion.

Having the mesh-clinging rainwater drop in to the middle of the gutter 220 rather than near the front lip 230 of the gutter 220 reduces the possibility that rainwater will run out of the gutter 220. However, because a higher wire count per inch functions to keep out leaves, pine needles and roof sand grit, etc. from entering the gutter 220, the mesh 235 will be stiffer and accordingly trough 245 can be close to or adjacent to the front strip connector 225.

The trough 245 can be, for example, V-shaped to provide stability, strength and rigidity for supporting the back bend 246 of the trough 245, as shown in FIG. 2 where the trough 245 is adjacent to the front strip connector 225. The front strip connector 225 can act as additional support for the trough 245 when adjacent to each other. It is important for the bend 246 along the length of the mesh 235 (nearly adjacent to the front strip connector 225) to be sufficiently rigid so as to sustain the span of the mesh 235 to rear strip connector 215. Another reason for the needed strength and support along bend 246 is if the mesh 235 ever becomes weighted down with leaves, pine needles, roof sand grit or snow and ice. The added strength prevents or reduces the possibility of the mesh 235 collapsing into the gutter 220.

The corrugations 212 on the mesh 235 of this embodiment 200, include at least one corrugation 213 that extends from an upper edge of the mesh 235 (near connector 215) into a portion of the trough 245. The corrugation 213 does not extend all the way through the through 245 to the lower edge of the mesh 235 (near connector 225). The corrugations 212 further include at least one corrugation 214 that extends from the lower edge of the mesh 235 through the trough 245. The corrugation 214 in this embodiment does not extend all the across the surface of the mesh 235 to the upper edge. In other exemplary embodiments, the corrugations do not extend into the trough.

Figure 3A:
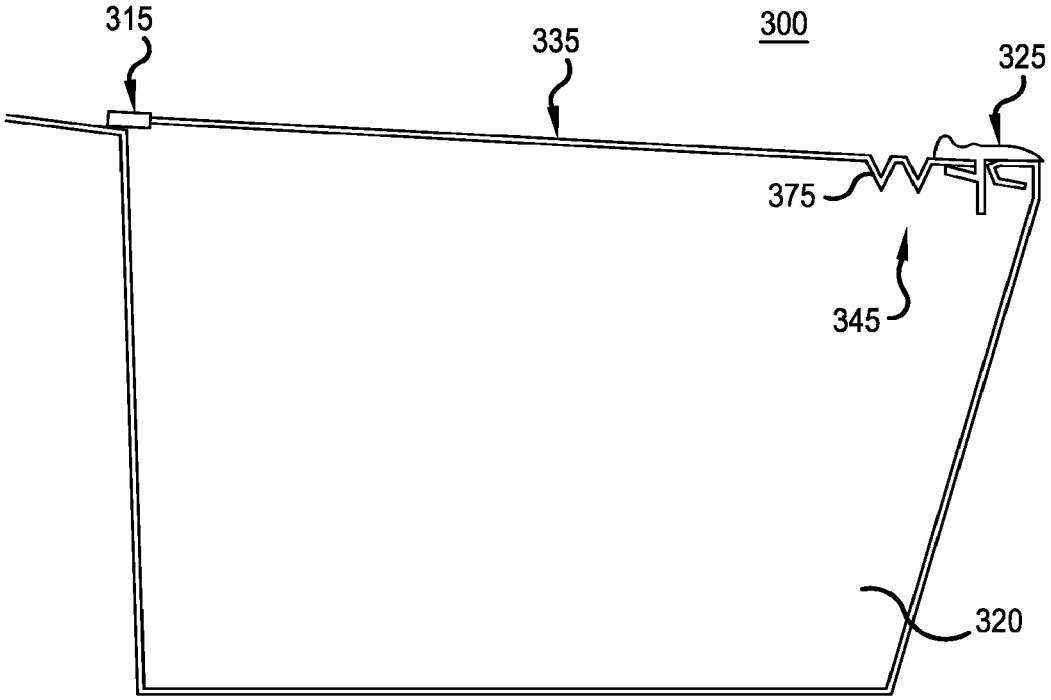
FIG. 3A is a side illustration of another mesh configuration with multiple troughs.

As shown in the cross-sectional illustration of FIG. 3A, the trough 345 can be composed of multiple troughs, the additional trough 375 appearing along the lower side of the mesh 335. The rationale for additional troughs is to provide more barriers, which act to divert higher flows of rainwater into the gutter 320. It is understood that higher flows of rainfall could potentially pass through a single barrier, which can arise from severe weather storms or from larger surface areas of a house roof where rainwater has accumulated in a roof valley and channeled to the inside corner of a covered gutter It is understood that the mesh 335 that is running adjacent to the front strip connector 325 can be formed into a variety of different shapes. It is further understood that the mesh 335 includes corrugations, not shown, that extend at least partially through the trough 375.

Figure 3B:
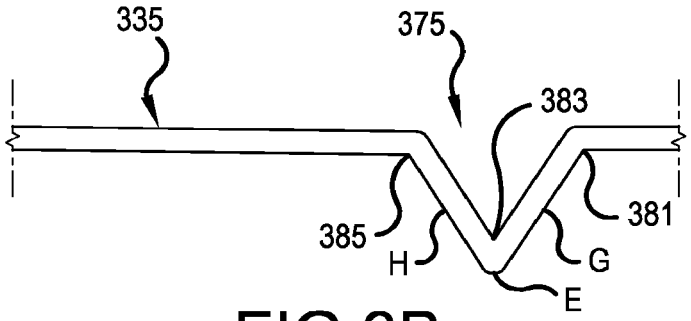
FIG. 3B is a cross-sectional close up illustration of an exemplary V-shaped trough.

FIG. 3B is a cross-sectional, close up illustration of an exemplary trough 375, with V-shape formed from three bends 381, 383, and 385; and is illustrative of how rainwater typically travels along the mesh 335 into the trough 375. Rainwater generally will travel under the mesh 335 and when encountering the barrier forming side/surface of the V-shaped trough 375, travels down and eventually drops off from the end E of bend 383, which forms the low point of trough 375. In some instances, rainwater will flow on the top of mesh 335 and flowing over bend 385 encounter side/surface G, which diverts the water into the bottom of trough 375. The entering water will drain through the apertures in surfaces Hand G, into the gutter (not shown).

Figure 4:
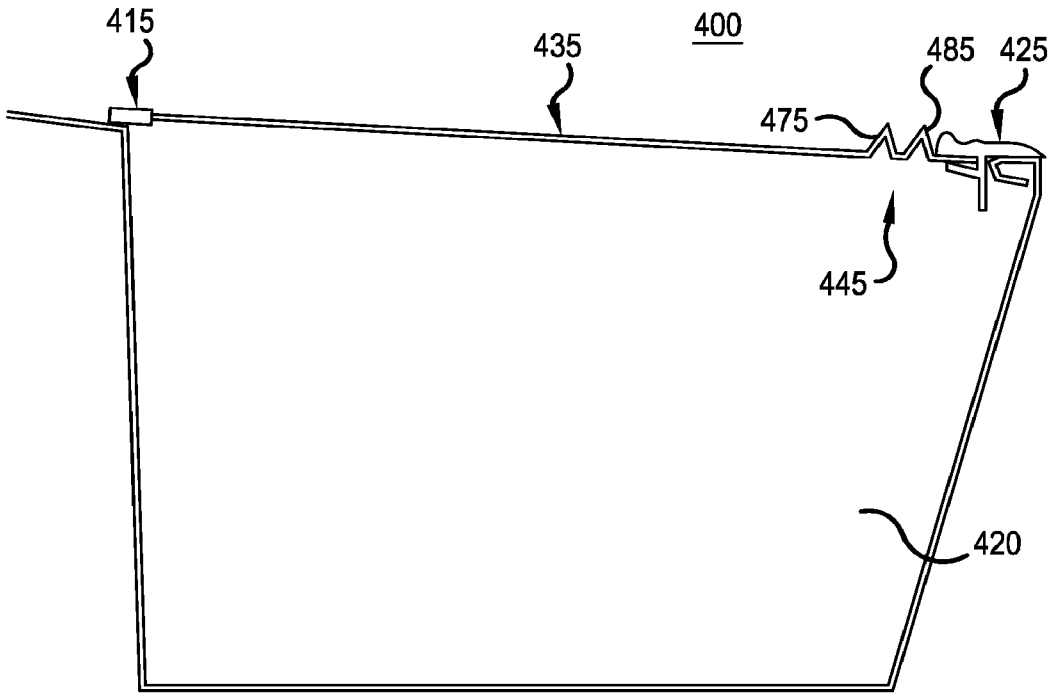
FIG. 4 is an illustration of an exemplary mesh with trough formed with a plurality of upward protruding barriers.
Figure 5A:
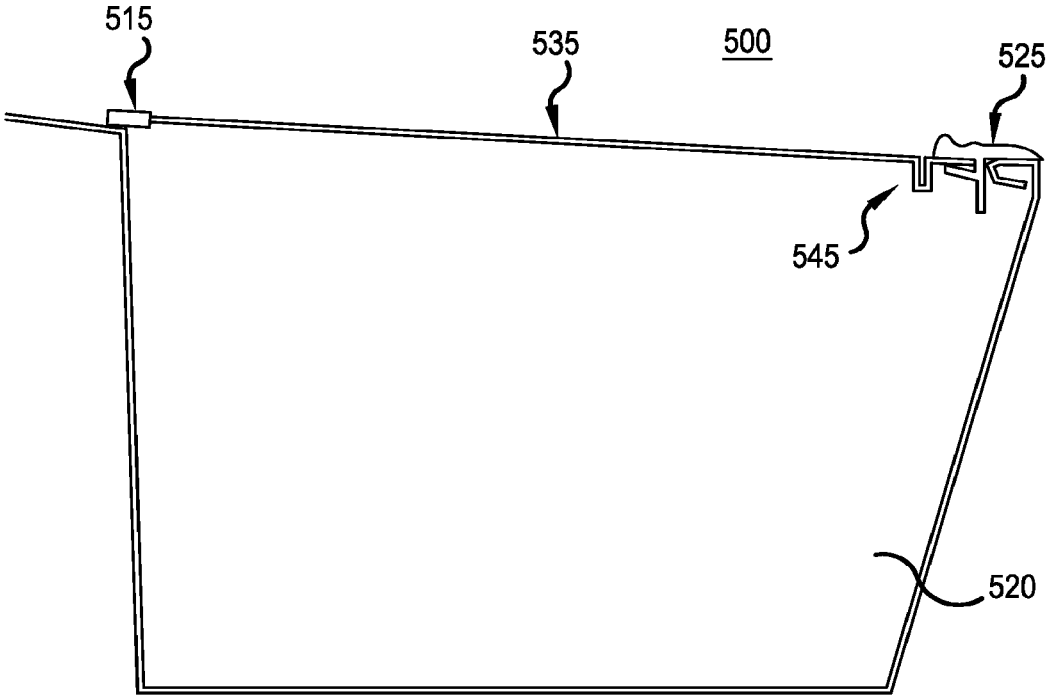
FIGS. 5A-B are illustrations of a mesh embodiment with a U-shaped trough.
Figure 5B:
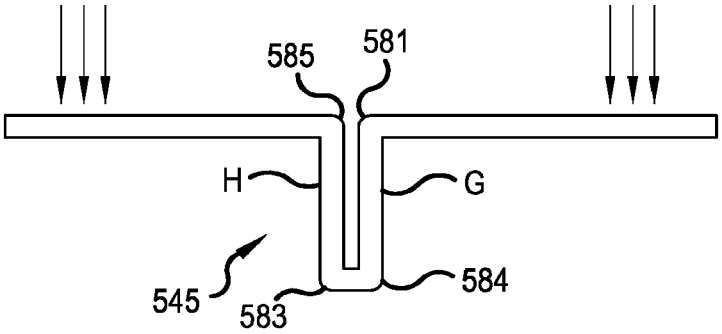

Understanding that additional and/or varied shaped troughs can also be formed, FIG. 4 is an illustration 400 of mesh 435 with trough 445 formed with a plurality of upward protruding barriers 475 and 485. In some embodiments, combinations of the froughs shown in FIGS. 2 and 3A may be utilized, as well as other shaped troughs. Accordingly, trough 445 can be an inverted V, U, laterally oriented L, or laterally oriented relaxed L shape, for example. It is further understood that the mesh 435 includes corrugations, not shown, that extend at least partially through the trough 445. FIGS. 5A-B are illustrations of an embodiment of a mesh 535 with a U-shaped trough 545, described here as having four bends 581, 583, 584 and 585. The principal rainwater barrier is formed by surface H, which forces under-mesh traveling water towards bends 583 and 584, which forms the lowest points of trough 545. The ensuing water can penetrate through surface H into drain through to neighboring surface G, or be diverted by surface H down towards bends 583 and 584, and fall into the gutter 520. It is further understood that the mesh 535 includes corrugations, not shown, that extend at least partially through the trough 545.

FIGS. 5A-B are illustrations of an embodiment of a mesh 535 with a U-shaped trough 545, described here as having four bends 581, 583, 584 and 585. The principal rainwater barrier is formed by surface H, which forces under-mesh traveling water towards bends 583 and 584, which forms the lowest points of trough 545. The ensuing water can penetrate through surface H to drain through to neighboring surface G, or be diverted by surface H down towards bends 583 and 584, and fall into the gutter 520. It is further understood that the mesh 535 includes corrugations, not shown, that extend at least partially through the trough 545.

It should be apparent that the V-shaped troughs in FIGS. 2-4 and the U-shaped trough(s) in FIGS. 5A-B only require a minimum of three bends in the mesh for the V-shape and four bends for the U-shape to form their shapes. The wall barrier formed by surface H in FIG. 5B has a unique feature in that if it is formed anywhere in the open surface area of mesh 535, even along the longitudinal midline axis of the gutter (e.g., further away from the front strip connector 525), the mesh 535 will retain a significant amount of its rigidity. Therefore, mesh 535 will be less likely to collapse in the gutter 520 from the weight of leaves, pine needles, roof sand, grit or snow and ice. This "supportability" is due to the fact that when downward pressure is applied to either sides of mesh 535, from debris, etc., bends 581 and 585 will push against each other to stiffen against further downward movement in mesh 535.

Figure 6A:
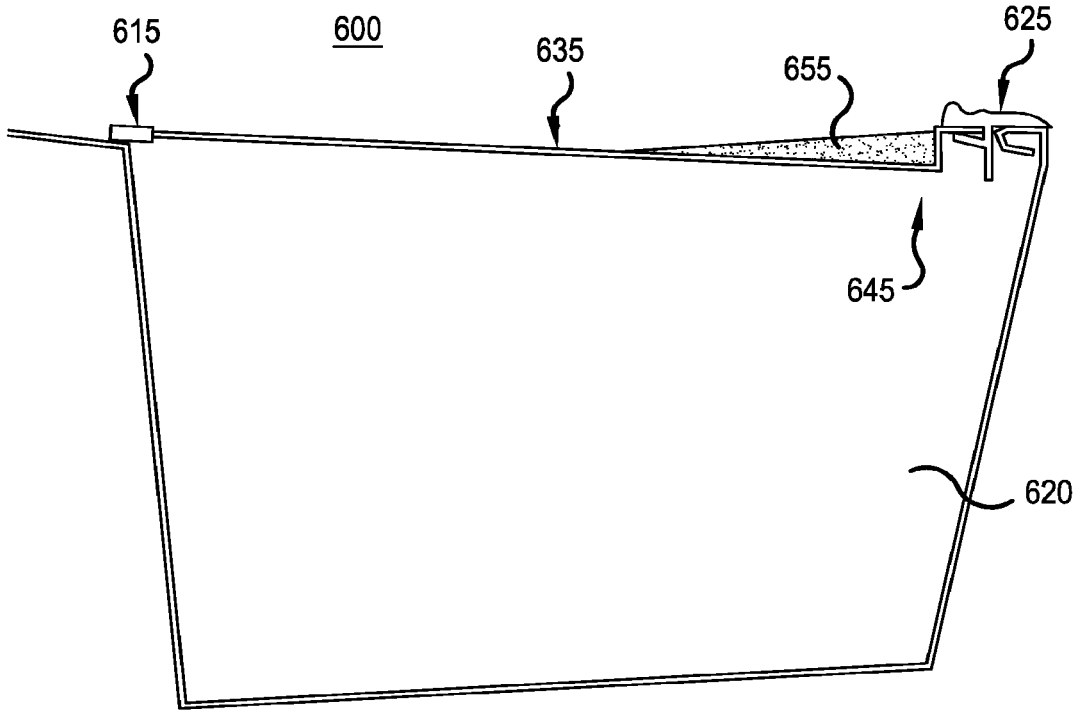
FIG. 6A is a side-view illustration of a mesh embodiment with a laterally oriented trough.

FIG. 6A is a side-view illustration of a mesh 635 embodiment with a laterally oriented L-shaped trough 645. The mesh 635 covers gutter 620 and is attached to the gutter's front and rear ends via rear strip connector 615 and front strip connector 625. The void formed by the trough 645 operates to provide a debris collection area 655. It is further understood that the mesh 635 includes corrugations 610 that extend at least partially through the trough 645. It is further understood that the mesh 635 includes corrugations, not shown, that extend at least partially through the trough 645.

Figure 6B:
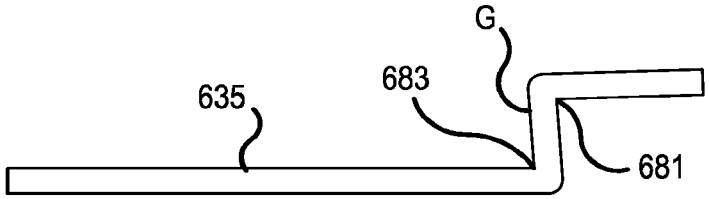
FIG. 6B is a close-up illustration of a laterally oriented L-shaped trough.

FIG. 6B is a close-up illustration of laterally oriented L-shaped trough 645, showing only two bends 681 and 683 in mesh 635, to form the trough 645. Two bends 681 and 683 create a firmer support structure of the surface area of the mesh 635 than with three displaced bends, the exception perhaps being the embodiment of FIGS. 5A-B, where the three bends are in close proximity to each other. Under-mesh 645 traveling rainwater will travel to bend 683, which form the lowest point of mesh 645, and drop into the gutter 620. Surface G operates as a dam against onrushing water and a collection area for debris, allowing accumulating water to drain through the respective apertures in the mesh 645.

Figure 7:
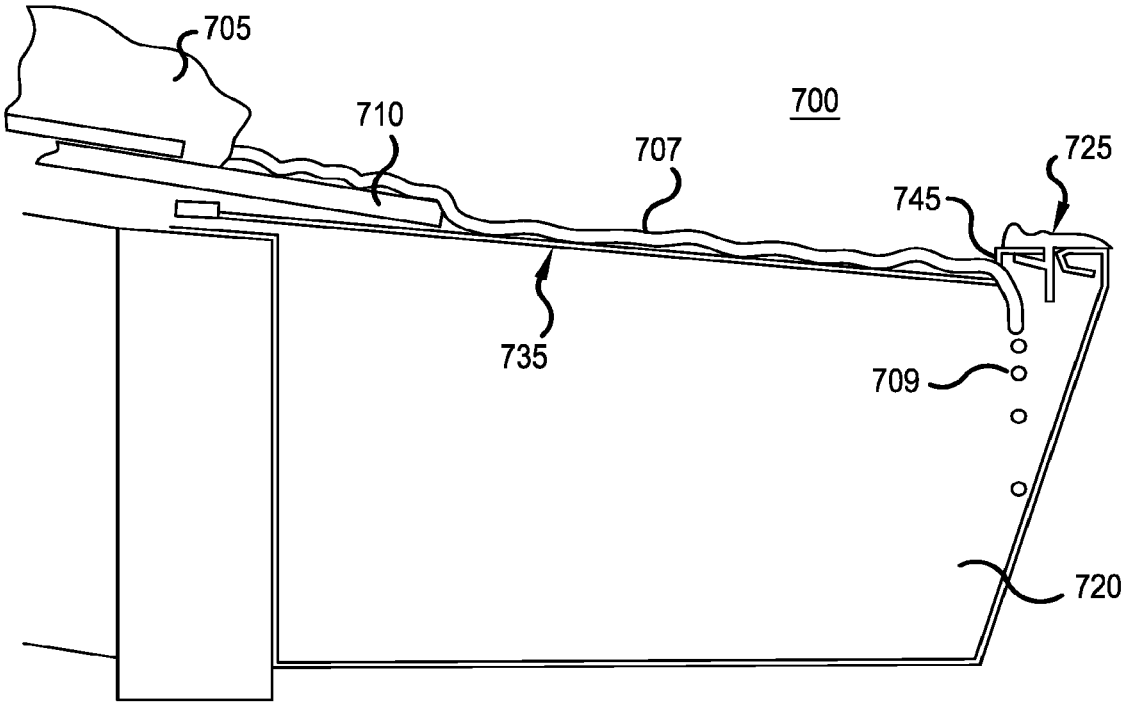
FIG. 7 is an illustration of the embodiment of FIG. 6A in a snowmelt situation.

FIG. 7 is an illustration of the embodiment of FIG. 6A in a snowmelt situation. Snow 705 accumulating on the roof shingles/surface 710 will melt to form snowmelt 707 over mesh 735 traveling towards the trough 745, which is connected to front strip connector 725. Water melting from snowmelt 707 penetrates the mesh 735 and travels under the mesh 735 to trough 745. The lowest point of the trough 745 (bend 683 in FIG. 6B) acts as the drip point, causing the water to drop 709 into the gutter 720. It is further understood that the mesh 735 includes corrugations 710 that extend at least partially through the trough 745. It is further understood that the mesh 735 includes corrugations, not shown, that extend at least partially through the trough 745.

Figure 8A:
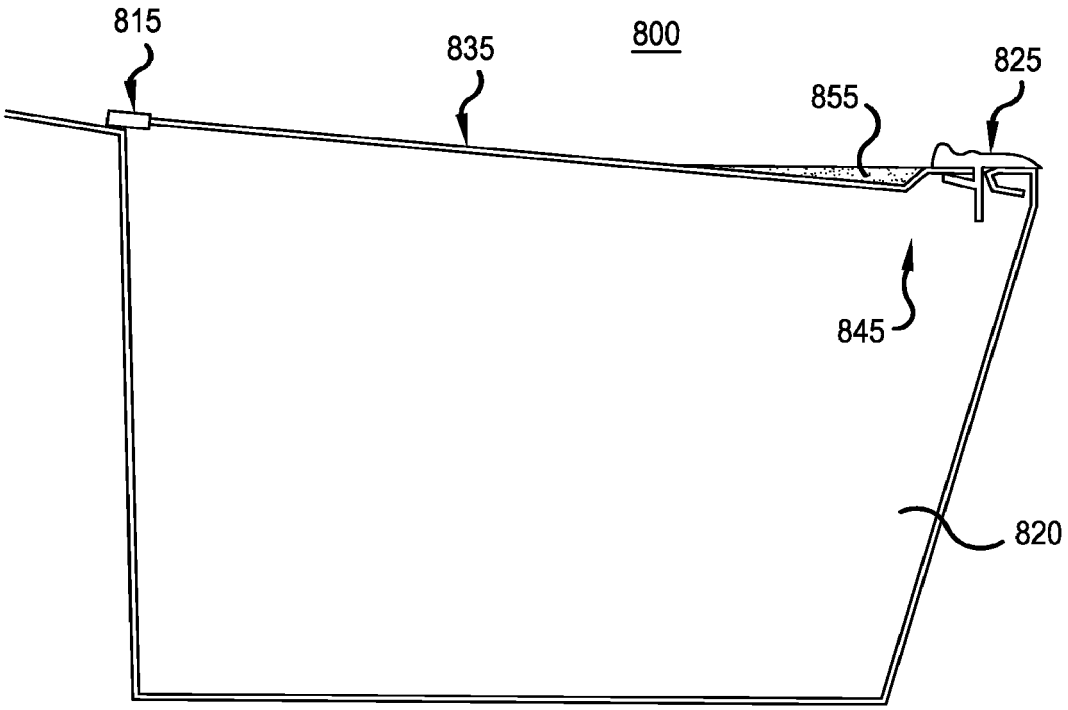
FIGS. 8A-B are illustrations of another embodiment wherein the trough has a laterally oriented relaxed L-shape.
Figure 8B:
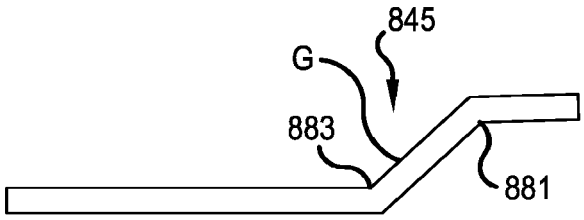

FIGS. 8A-B are illustrations of another embodiment wherein the trough 845 has a laterally oriented relaxed L-shape for accommodating debris, shown here as the debris collection area 855. FIG. 8A illustrates the mesh 835 attached to the gutter/roof via strip connectors 815 and 825. Noticeable is that an angle of the plane of the mesh section-to-gutter strip connector 825 is different than the angle of the plane of the mesh section-to-roof strip connector 815, forming an offset occupied by the trough 845. Trough 845 is disposed in the mesh 835 proximal to the front strip connector 825, which is attached to the gutter 820. The trough 845 is formed from two bends 881 and 883 in the mesh 845, however, the surface G between the two bends 881 and 883 is less vertical than in the embodiments shown in FIGS. 6A-B. The "less than vertical" orientation results in a "softer" or not as steep of a slope for the barrier or surface G to accumulated debris in the trough 845. That is, since the surface G is sloped, the debris will likely blow off of the gutter cover more easily than in the embodiment shown in FIGS. 6A-B It is further understood that the mesh 835 includes corrugations 810 that extend at least partially through the trough 845. It is further understood that the mesh 835 includes corrugations, not shown, that extend at least partially through the trough 845.

Figure 9:
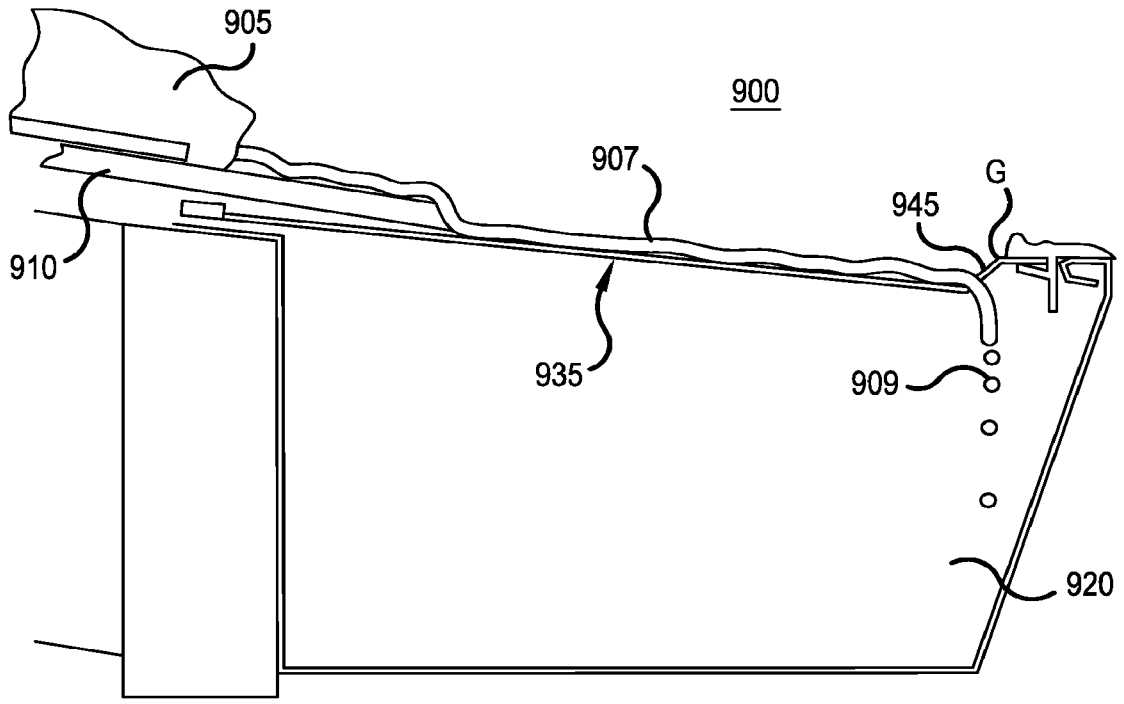
FIG. 9 is an illustration of the embodiments of FIGS. 8A-B in a snowmelt situation.

FIG. 9 is an illustration of the embodiments of FIGS. 8A-B in a snowmelt situation. Snow 905 accumulating on the roof shingle surface 910 will melt to form snowmelt 907 over mesh 935 traveling towards the trough 945, which is connected to front strip connector 925. Water melting from snowmelt 907 penetrates the mesh 935 and travels under the mesh 935 to trough 945. The lowest point of the trough 945 (bend 883 in FIG. 7B) acts as the drip point, causing the water to drop 909 into the gutter 920. It is further understood that the mesh 935 includes corrugations, not shown, that extend at least partially through the trough 945.

Both trough designs shown in FIGS. 8 and 9 provide a feature that significantly reduces potential snowmelt runoff over the gutter cover and unto the ground. To fully appreciate the snowmelt feature, an understanding of the snowmelt runoff problem is necessary. When a permeable mesh type gutter cover material is not exposed to rain or snow, but there is snow on top of the roof, when the snow begins to melt it can drip off the edge of the gutter cover and the gutter. This problem is mainly seen in the micro-mesh type gutter covers with hole openings less than 0.125" square.

The reason the snowmelt exits over the side of a mesh gutter cover is because the mesh is not wet since there is no rain. Moreover, it is possible the mesh is frozen, preventing penetration of the snowmelt into the mesh. In either instance, the snowmelt coming down the roof tends to not penetrate the permeable mesh material and consequently runs along the top of the mesh and then over the front of the gutter. It should be understood that snowmelt can occur in below freezing weather, wherein the roof under the snow is warmed by the home's heat, causing the snowmelt.

In contrast, when it is raining (which means the temperature is above freezing), snowmelt will come off the roof and with the mesh wet from the rain, the snowmelt will drop through the mesh and into the gutter. The warming rain droplets striking any snowmelt on the mesh will also help force the snowmelt through the mesh.

Because of the snowmelt issue, the downward trough designs illustrated in FIGS. 7 and 9 incorporate the barrier formed by surface G, which provides a permeable mesh wall that the melted snow can penetrate through. Typically, when snowmelt travels down the roof and onto the mesh of FIGS. 7 and 9, it can travel between 3 and 10 miles per hour, depending on the steepness angle of the roof, when the snowmelt hits the surface G, its momentum can force the snowmelt through the apertures of surface G and drop down into the gutter. When the debris collection area 655, 855 has no debris sitting in it, the functionality and purpose of the downward sides of surface G are greatly enhanced.

Figure 10A:
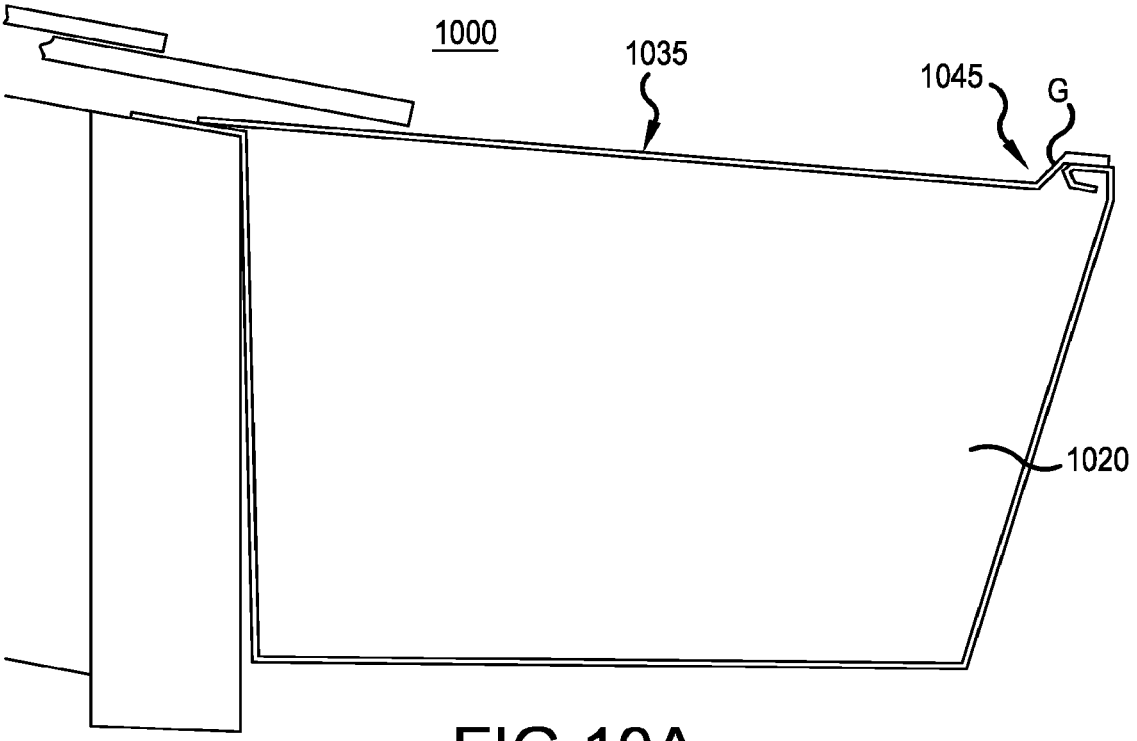
FIGS. 10A-B are illustrations of another gutter cover embodiment not requiring the front and rear strip connectors.
Figure 10B:
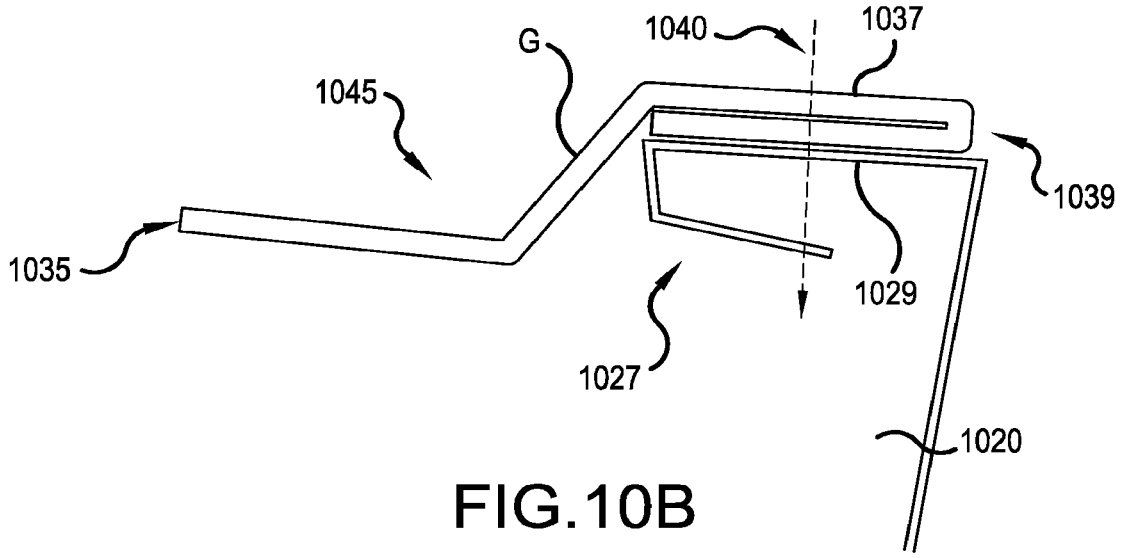

FIGS. 10A-B are illustrations of another gutter cover embodiment, wherein either one or more or the front and rear strip connectors is not utilized. For example, the front of mesh 1035, having trough 1045, can be fastened to the front lip 1027 of the gutter 1020 and the rear of the mesh 1035 can be laid on the back lip of the gutter 1020, without the need of fastening it to any strip connector. In this scenario, the front lip 1027 of the gutter 1020 acts like a front connector support to hold up the surface area of the mesh 1035 when a screw (not shown) is fastened through the top end portion 1037 of the mesh 1035 and through the gutter's top ridge 1029. The screw can be placed through any section of the top ridge 1029 however typically is fastened along the dimensional line 1040. To further create additional support, the mesh 1035 can be folded into a flap 1039, which provides additional strength on the mesh 1035 screwed to the gutter 1020. It is further understood that the mesh 1035 includes corrugations, not shown, that extend at least partially through the trough 1045.

While FIG. 10B shows a single fold, additional folds can be implemented for greater strength and support. In this embodiment, the trough 1045 is adjacent to the front lip 1027 of the gutter 1020. As stated earlier, in various other embodiments, the trough 1045 may be disposed at an arbitrary distance from the front of the gutter 1020.

Also, in various embodiments, the trough(s) shown may be composed of the mesh material with or without corrugations. That is, one or more of the trough surfaces H and/or G (seen in FIG. 3A or 3B) may be non-corrugated. For example, the mesh "corrugations" could begin from the rear strip connector and continue to the second bend in the trough, or stop at the first bend and resume from the second bend. In other embodiments, as seen in FIGS. 6B and 8B, because there is sufficient strength in the mesh on the surface G, due to being supported by the front strip connector, the mesh corrugations could go from the rear strip connector and stop at the second bend. It should be understood that the term corrugation can be interpreted as a structure that provides apertures for drainage, such as aperforation, slot, slit, overlaying wires with gaps, and so forth in the respective gutter cover.

Figure 11:
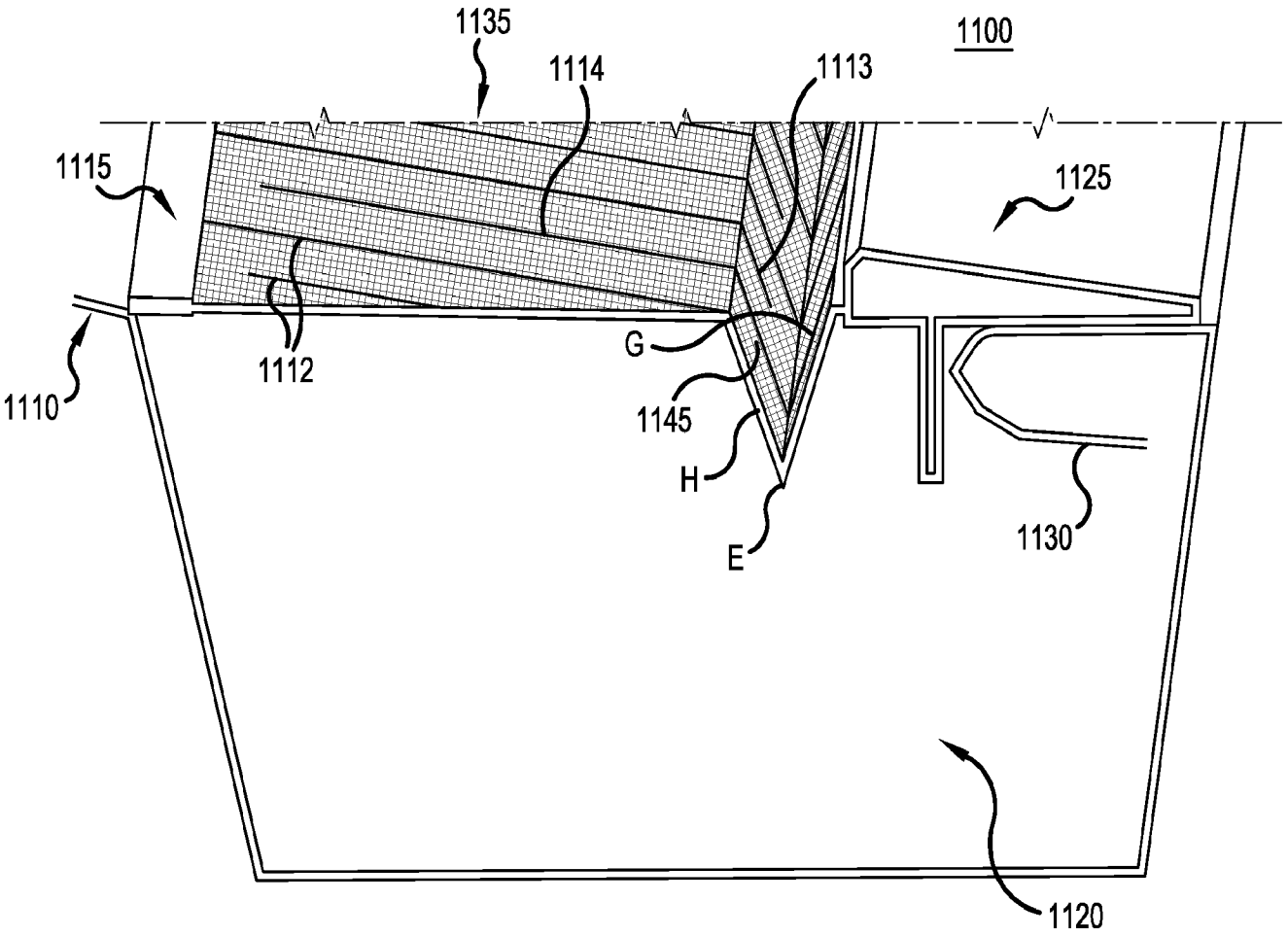
FIG. 11 is an illustration of another gutter cover embodiment not requiring the front and rear strip connectors.

FIG. 11 is a semi-side cut-away illustration 1100 of the embodiment of FIG. 1A. As illustrated, when the mesh 1135 connects to the back of the roof 1110 and the gutter 1120, via strip connectors 1115 and 1125, a natural downward slope in mesh 1135 is created toward the front lip 1130 of gutter 1120. This embodiment is similar to the embodiment of FIG. 2, in that it includes a trough 1145 having surfaces G and H, along with the end point E. The device 1100 also has corrugation 1113, which extends into the trough 245 and corrugation 1114, which does not extend all the way to the top end of the mesh near connector 1115. A difference with the present embodiment is that the corrugations 1112 extend in a non-perpendicular direction relative to the gutter lip 1130.

Whereas in the embodiment shown in FIG. 2, the corrugations are substantially perpendicular to the gutter lip. It should be appreciated that in other exemplary embodiments, the corrugations extend along the mesh in a variety of manners. Still further, in other embodiments, the corrugations extend along the mesh in differing angles relative to the gutter lip or the strip connector.

The present disclosure is not to be limited in terms of the particular embodiments described in this application, which are intended as illustrations of various aspects. Many modifications and variations can be made without departing from its scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, implementations, and realizations, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A gutter debris preclusion device for securing to a top portion of a gutter that is attached to a building, comprising:

a mesh with corrugations having a roof side, a gutter lip side, and at least one trough with corrugations, wherein the mesh is configured to substantially cover a gutter when the device is installed over the gutter, and one or more troughs of the at least one trough is disposed proximal to and parallel to the gutter lip side; and a gutter lip end of the mesh a gutter lip rail attached to the gutter lip side of the mesh.

2. The device of claim 1, wherein the mesh is formed from stainless steel wires, plastic, expanded metal, perforated metal, slotted metal or louvered metal.

3. The device of claim 1, wherein the corrugations in the mesh are configured to provide a planar stiffness to the mesh causing the mesh to be self-supporting over the gutter.

4. The device of claim 1, wherein the corrugations in the mesh are formed via at least one of stamping, pressing, and weaving.

5. The device of claim 1, wherein a trough of the at least one trough is displaced up to 1.5" from the gutter lip rail.

6. The device of claim 1, wherein a trough of the at least one trough is displaced up to 0.25" from the gutter lip rail.

7. The device of claim 1, further comprising a second trough disposed in the mesh along a longitudinal axis of the of mesh.

8. The device of claim 1, wherein a trough of the at least one trough is disposed adjacent to the gutter lip side.

9. The device of claim 1, further comprising a roof rail attached to the roof side of the mesh.

10. The device of claim 1, wherein a bottom of a trough of the at least one trough is below in elevation from a top of the gutter lip rail.

11. The of claim 1, wherein a trough of the at least one trough has a gutter lip side wall inclined in a direction towards the gutter lip rail and has a roof side wall joined to a bottom of the gutter lip side wall and inclined at an angle greater than 90 degrees from the gutter lip side wall, wherein the roof side wall is longer than the gutter lip side wall.

12. The device of claim 11, wherein the gutter lip side wall is proximal to the gutter lip rail.

13. The device of claim 1, wherein a cross-section of the at least one trough is U-shaped.

14. The device of claim 1, wherein a cross-section of the at least one trough is partially U-shaped.

15. A gutter debris preclusion device for securing to a top portion of a gutter that is attached to a building, comprising:

a mesh having apertures, corrugations, a roof side, a gutter lip side, a gutter lip portion, and a water dam with corrugations disposed proximal to and parallel to the gutter lip portion, wherein the mesh is configured to substantially cover a gutter when the device is in use; and a gutter lip rail attached to the gutter lip portion.

16. The device of claim 15, wherein the water dam is formed from a first and second wall, joined at a bottom, wherein the bottom is below the gutter lip rail when the device is in use.

17. The device of claim 15, further comprising a plurality of water dams.

18. The device of claim 16, wherein at least one of the first and second wall is curved.

19. The device of claim 16, wherein the joined walls form a contiguous curved shape.

20. The device of claim 16, wherein a top portion of the first wall is connected to a gutter lip.

21. The device of claim 16, further comprising a roof side rail attached to the roof side.

22. A gutter debris preclusion device for securing to a top portion of a gutter that is attached to a building, comprising:

a mesh having apertures, corrugations, a roof side, a gutter lip side, and a gutter lip portion terminating the gutter lip side, wherein the mesh is sized to substantially cover a gutter;

wherein a first plane of the gutter lip side is different from a second plane of the roof side, forming at least one offset between the first and second planes, the at least one offset being bridged by one or more third planes of the mesh; and wherein a roof side end of the one or more third planes of the mesh being lower than a gutter lip side end of the one or more third planes of the mesh.

23. The device of claim 22, wherein a width spanned by the first plane is less than a width spanned by the second plane.

24. The device of claim 22, wherein a depth of the at least one offset operates as a water reservoir.

25. The device of claim 22, wherein the corrugations are disposed in the second plane.

26. The device of claim 22, wherein the corrugations are disposed in the one or more third planes.

27. The device of claim 22, wherein a cross-section of the at least one offset is curved in shape.

28. A gutter debris preclusion device for securing to a top portion of a gutter attached to a building, comprising:

a water permeable mesh having corrugations, a roof side, a gutter lip portion, and a trough disposed parallel to and proximal to the gutter lip portion, wherein the mesh is sized to substantially cover a prospective gutter attached to a prospective building, wherein the trough has a longer first wall extending towards the roof side and a shorter second wall extending towards the gutter lip portion, wherein a shape of the longer first wall and shortrer second wall form a 2-sided reservoir, and wherein a bottom point of the reservoir is lower than the gutter lip portion; and a gutter lip attachment member coupled to the gutter lip portion.

29. The device of claim 28, wherein an angle between the longer first wall and shorter second wall is greater than 90 degrees.

30. The device of claim 28, wherein an angle between the longer first wall and shorter second wall is less than 90 degrees.

31. The device of claim 28, wherein the mesh is formed from stainless steel wires, plastic, expanded metal, perforated metal, slotted metal or louvered metal.

32. The device of claim 28, further comprising a roof strip connector adapted to connect the roof side to either a rear of the gutter or a roof element neighboring the gutter.

33. The device of claim 28, wherein at least one of the first and second walls contains another angled bend to form a segmented or a curved reservoir bottom.

* * * * *